United States Patent [19]

Egler

[11] Patent Number: 4,811,899

[45] Date of Patent: Mar. 14, 1989

[54] APPARATUS FOR GENERATING PRE-INJECTIONS IN UNIT FUEL INJECTORS

[75] Inventor: Walter Egler, Stuttgart, Fed. Rep. of Germany

[73] Assignee: Robert Bosch GmbH, Stuttgart, Fed. Rep. of Germany

[21] Appl. No.: 91,155

[22] Filed: Aug. 31, 1987

[30] Foreign Application Priority Data

Sep. 1, 1986 [DE] Fed. Rep. of Germany ..... 3629754

[51] Int. Cl.[4] ..... F02M 47/02

[52] U.S. Cl. ..... 239/5; 239/90; 239/91; 239/93; 239/96; 239/585; 123/299; 123/447

[58] Field of Search ..... 239/5, 88, 90, 91, 93, 239/96, 533.4, 533.5, 533.7, 533.8, 585, 92, 94; 123/299, 300, 447

[56] References Cited

U.S. PATENT DOCUMENTS

| | | | |
|---|---|---|---|
| 3,392,715 | 7/1968 | Thomas | 123/299 X |
| 3,394,891 | 7/1968 | Voit | 123/299 X |
| 3,627,208 | 12/1971 | Scott et al. | 123/299 X |
| 4,108,383 | 8/1978 | Thoma | 239/533.5 |
| 4,258,883 | 3/1981 | Hofmann et al. | 239/533.5 X |
| 4,289,098 | 9/1981 | Norberg et al. | 123/299 |
| 4,669,659 | 6/1987 | Leblanc et al. | 239/91 |
| 4,681,080 | 7/1987 | Schukoff | 123/299 X |
| 4,704,999 | 11/1987 | Hashikawa et al. | 123/299 |

FOREIGN PATENT DOCUMENTS

| | | | |
|---|---|---|---|
| 289469 | 4/1971 | Austria . | |
| 1284687 | 12/1968 | Fed. Rep. of Germany . | |
| 1576478 | 1/1970 | Fed. Rep. of Germany . | |
| 2509068 | 9/1976 | Fed. Rep. of Germany . | |
| 810456 | 9/1955 | United Kingdom | 123/300 |
| 1235501 | 6/1971 | United Kingdom . | |

*Primary Examiner*—Andres Kashnikow
*Assistant Examiner*—Mary Beth O. Jones
*Attorney, Agent, or Firm*—Edwin E. Greigg

[57] ABSTRACT

In an apparatus for generating pre-injection quantities in unit fuel injectors for Diesel engines, including a pre-injection slide that generates a pronounced pressure intensification for a pre-injection in a pressure chamber closed off with respect to the high-pressure side and opens towards the injection line is slidably supported in a guide bore. The pre-injection slide is exposed to the injection pressure of an element chamber in such a way that after the execution of a partial stroke, which is responsible for the pre-injection quantity, upon further movement the pre-injection pressure chamber is opened toward the element chamber and thereby relieved, and by the ensuing movement of the pre-injection slide until the end of the stroke, a pre-determinable capacity that enables an injection pause is formed. A valve which is supported inside the pre-injection slide is under the control of a magnetic valve associated with the unit fuel injector and provides for the filling of the pre-injection pressure chamber forms selectively actuatable shutoff control for the pre-injection.

25 Claims, 3 Drawing Sheets

APPARATUS FOR GENERATING PRE-INJECTIONS IN UNIT FUEL INJECTORS

BACKGROUND OF THE INVENTION

The invention is based on an apparatus as defined hereinafter. In a known apparatus for generating pre-injections for internal combustion engines, in particular Diesel engines U.S. Pat. No. 4,108,383, a fuel injection valve which is intended for graduated injection, that is, without a marked time interval or an intervening valve closure between a pre-injection and a main injection, is associated with a pre-injection piston that is preceded coaxially by a main injection piston that mechanically rests directly on the pre-injection piston.

The high fuel pressure produced by an injection pump acts upon the main injection piston, which undergoes a displacement counter to a spring pressure that has a feedback effect on the pre-injection piston. This displacement causes the pre-injection piston to emit a corresponding pre-injection quantity, and immediately after a predetermined pre-injection stroke is exceeded opens up a connection with the injection line. Although the main injection piston and the pre-injection piston in the known apparatus are embodied as stepped, so that intrinsically a pressure intensification could occur, it is expressly arranged that a fuel quantity having a feedback effect on the main injection piston and located in an outlet-side pressure chamber of the main injection piston is supplied via (throttled) transverse conduits to a pressure reservoir, so that while a pressure intensification is avoided, the injection pressure in the initial stage of injection (i.e., during pre-injection) is absolutely the same as during the main stage, with the single difference that in the initial stage, smaller quantities are injected. In this known fuel injection valve having graduated injection, there is no possibility for providing a pause in injection between the various stages or injection, or for shutting off the pre-injection completely.

It is generally known (German Offenlegungsschrift 1 576 478, German Pat. No. 1 284 687, or UK Pat. No. 1,235,501 for a fuel injection valve for pre- and main injection to be associated with a small spring-biased pre-injection piston, typically disposed parallel to the nozzle needle, and to subject the high-pressure side of the fuel injection valve to fuel in such a way that initially the pre-injection takes place by the movement of the small pre-injection piston and then the main injection is performed, optionally after an injection pause, once a predetermined state of equilibrium is attained between the faces acted upon by fuel and the spring forces acting upon various control elements or valves. In these known fuel injection valves, there is typically either no pressure intensification or only such a slight one in the vicinity of the pre-injection that by opening up the high-pressure-side fuel connection no seemingly backward-oriented pressure relief is brought about in any case in the pre-injection region by connection of the injection line with the high-pressure side; in the present invention, this is of functionally decisive significance. Since the spring influences and pressure equilibriums vary in their performance because of aging, adaptation to them causes inaccuracies in the desired piston capacity, this capacity being definitive for the injection pause between the pre-injection and the main injection. Finally, in the known fuel injection valves having pre-injection and main injection, the pre-injection cannot be selectively shut off from outside merely by the action of electrical control means.

OBJECT AND SUMMARY OF THE INVENTION

It is the object of the invention to provide an apparatus for generating pre-injection quantities in unit fuel injectors for internal combustion engines, in particular Diesel engines, which is particularly simple in structure yet with which, on the other hand, both a highly accurate metering of the pre-injection quantity and the injection pause are made possible, and in which, additionally, a selective shutoff of the pre-injection should be possible.

In the apparatus according to the invention, this object is attained with the advantage that after effecting the pre-injection a very high pressure, resulting from the pressure intensification—as a result of which the pre-injection can also be arranged at a time near the beginning of the supply onset—a marked relief of one injection line leading to the injection nozzle takes place, specifically by opening up the communication between the pre-injection pressure chamber with the element chamber on the high-pressure side. This relief is effected by the resumption, after this opening up, of the downward movement of the pre-injection slide, which predetermines a specific capacity and thus also enables a precise definition and positioning of the injection pause, until afterward, namely after the pre-injection slide has met its stop, the pressure for the main injection builds up.

Another advantage in this connection is that as a result of the pressure stage formed by the pre-injection slide, the pre-injection quantity is finely metered, and the pressure intensification at the pre-injection slide combines this finely metered pre-injection quantity with a long stroke. In other words the structure combines the advantage of a finely metered pre-injection quantity with the advantage of a long stroke. Then the remaining stroke of the pre-injection slide is definitive for the injection pause, and this remaining stroke, along with the area of the end face of the pre-injection slide, defines the piston capacity.

The disposition of a great number of active components in minimum space enables arranging the apparatus according to the invention as an intermediate part in a unit fuel injector, between the high-pressure portion and the nozzle.

It will be appreciated by those skilled in the art that further advantageous developments of and improvements to the apparatus disclosed herein are possible. A particular advantage is the possibility of providing a shut off control means which can be disposed as a valve which is revealed hereinafter as being positioned inside the pre-injection slide.

As a result of such a shutoff control means, which can be activated selectively and—which enables a particularly advantageous embodiment—by means of a correspondingly timed additional triggering of the magnetic valve of the unit fuel injector, it is possible to dispense with the pre-injection, depending on the operating point in the performance graph approached by the engine, such as load and rpm, or to resume the pre-injection, after leaving that operating point or operating point range. To do so, no mechanical intervention or adjusting movements in the vicinity of the unit fuel injector are required at all.

Since the shutoff control means is embodied as a valve which is integrated into the pre-injection slide and has its own performance characteristic, and which becomes operative only in he injection pauses or in other words during the intake stroke, no additional space is required, despite this advantageous possibility of selectively authorizing or suppressing the pre-injection.

The invention will be better understood and . further objects and advantages thereof will become more apparent from the ensuing detailed description of preferred embodiments taken in conjunction with the drawings.

DESCRIPTION OF THE PREFERRED EMBODIMENTS

In a so-called direct-controlled unit fuel injector, the basic concept of the present invention is to embody an intermediate part adjoining the element chamber on one side and the continuing region of the nozzle on the other. The intermediate part in another embodiment being capable for instance of receiving a cylinder valve, in such a way that a pronounced and clearly definable pre-injection with a predeterminable pause duration interval with respect to the main injection can be realized in Diesel engines. This is done by providing that a pre-injection and relief slide is disposed in the shunt around the injection line leading from the element chamber to the nozzle and is operated in such a way that for the pre-injection, after supply onset, a pressure intensification takes place, which leads to the pre-injection.

Figure 1:
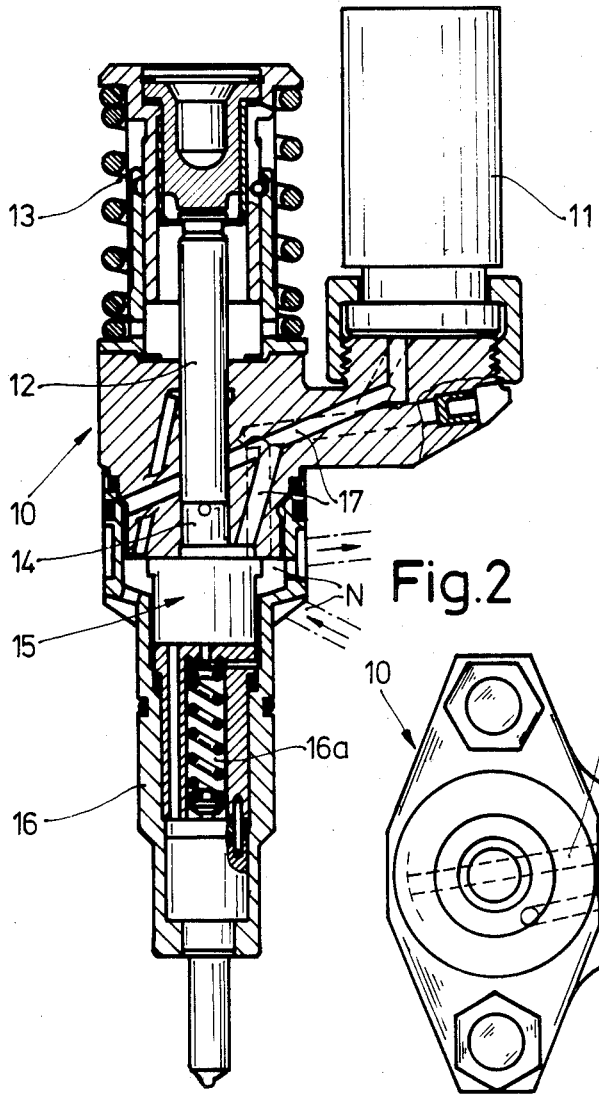
FIG. 1 is an overall view of a unit fuel injector, comprising a high-pressure portion, an associated electrical magnetic valve, an intermediate part for the pre-injection, and a nozzle, seen in a side view, partly in section.

For the sake of general comprehension of the invention, a direct-controlled unit fuel injector 10 is shown in FIG. 1, in a side view, partly in section, having a magnetic valve 11; an actuation part 13 acting mechanically, via cams or the like, upon a spring-biased high-pressure piston 12, the piston 12 acting upon the high-pressure or element chamber 14; the aforementioned intermediate part 15; and the injection nozzle 16 adjoining it at the bottom.

The basic function of a unit fuel injector of this type is such that the magnetic valve 11, triggered electrically by a suitable control unit, or microprocessor or the like, assures the filling of the high-pressure portion (element chamber 14) by providing that between the individual injections, fuel flows to the magnetic valve 11 from a low-pressure side N shown only in part, so that with the magnetic valve open, the fuel flows through the conduits 17 to reach the high-pressure or element chamber 14. The injection event comes about in that the magnetic valve, upon the mechanical actuation of the high-pressure piston 12, closes the inflow conduits in timely fashion; as a result, the high pressure required for example for the injection and for actuation of the following nozzle-closing mechanism can build up in the high-pressure or element chamber 14. In this manner, the magnetic valve can control the injection onset and thus, suitably adapted to the extent of the stroke of the high-pressure piston 12 and to the stroke end, can control the duration of the injection, resulting in a determination of the quantity of fuel supplied per injection.

Figure 2:
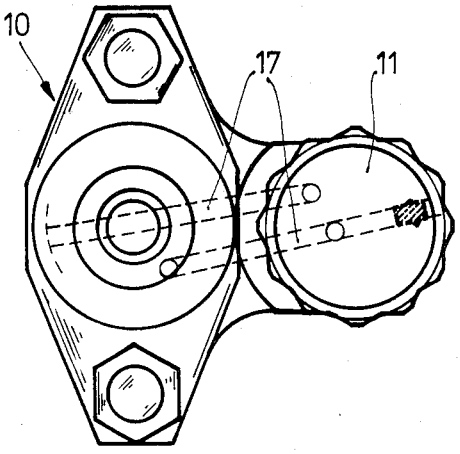
FIG. 2 shows the unit fuel injector of FIG. 1 in a plan view.

In FIG. 1, the nozzle spring chamber is also visible at **16*a* comprising a spring 16*b*; the plan view of FIG. 2 shows that the magnetic valve 11 is an integrally mounted part of the unit fuel injector and supplies the element chamber 14 with fuel via the conduits 17**, or is supplied with fuel from the low-pressure side N.

Figure 3:
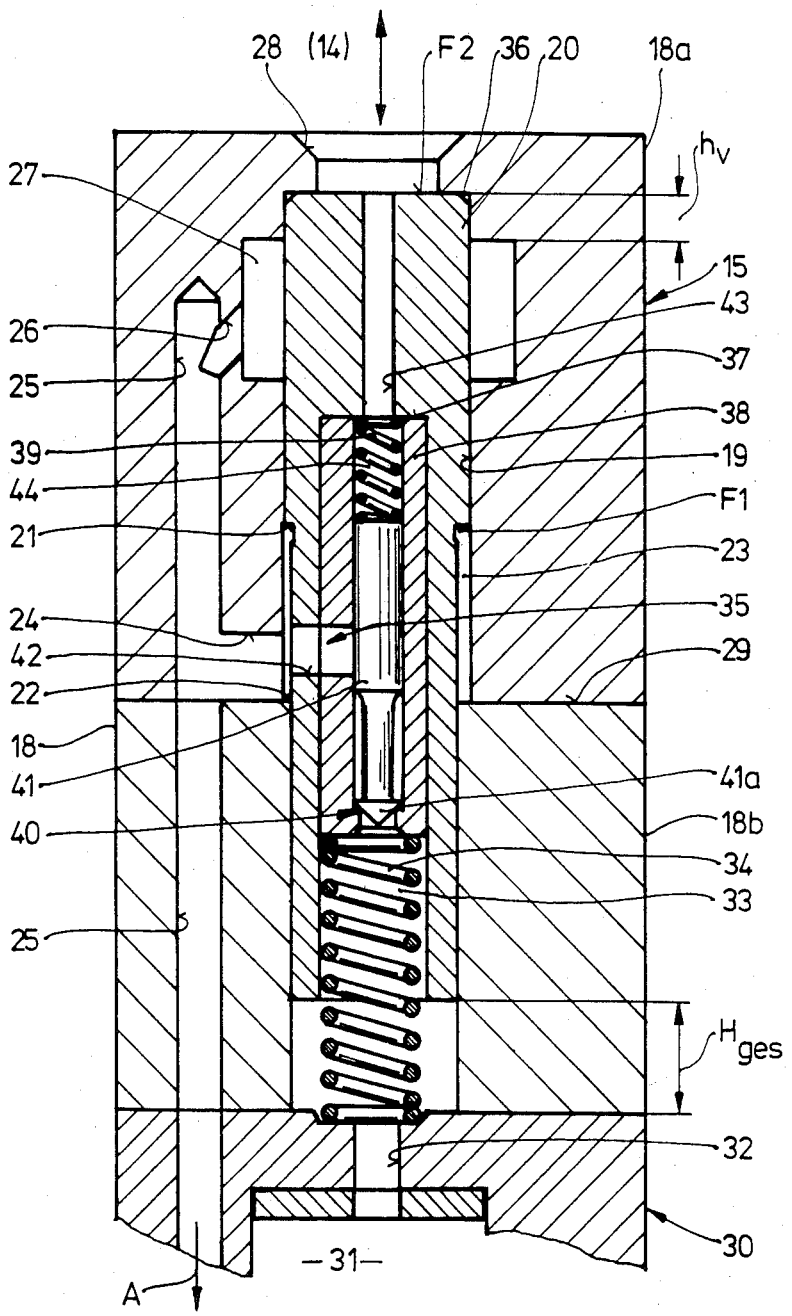
FIG. 3 is a detail in longitudinal section showing the intermediate part of the unit fuel injector, which is disposed between the high-pressure portion and the nozzle and enables the embodiment and timing adaptation of pre-injections with respect to various subsequent main injections.

Because of the embodiment of the intermediate part 15, which is shown in detail in FIG. 3, the invention succeeds in generating a precisely predeterminable pre-injection quantity in a likewise temporally pre-determinable interval with respect to the main injection by means of corresponding dimensioning of a predeterminable capacity; the particular pre-injection quantity is supplied not as part of the total injection quantity per stroke generated by the action of the high-pressure portion, but rather is made available in the shunt from fuel originating in the low-pressure side by means of a corresponding pressure intensification, derived from the pressure in the element chamber. A shutoff means is also provided, which by exploiting the control properties of the already necessarily provided magnetic valve even suppresses the pre-injection entirely, depending on operational requirements of the Diesel engine supplied with the fuel (i.e., depending on the operating point in the performance graph).

The intermediate part 15 for the pre-injection apparatus includes a (cylinder) housing 18 including an upper housing portion **18*a* and a lower housing portion 18*b*; having an inner bore 19 forming a slideway for a pre-injection slide 20. The bore 19 of the upper housing portion 18*a* is larger in diameter than the bore in the lower housing portion 18*b*. Therefore, the diameter of the upper portion of slide 20 is larger than the diameter of the lower portion to provide a shoulder 21. The spacing below the shoulder 21 in the upper housing portion 18*a* forms a pressure chamber 23**.

By means of the annular shoulder 21, face F1, on the pre-injection or relief slide 20, in combination with the larger bore diameter of the bore 19 in the upper housing portion **18*a* pre-injection intermediate part 15 that is offset at 22 forms the pressure chamber 23 for the pre-injection. The pressure chamber 23 communicates via a transverse connecting channel 24 with the injection line 25 leading to the nozzle 16. The injection line also communicates with the element chamber 14, via an intermediate conduit segment 26 and an annular chamber 27 of basically arbitrary dimensions with which the bore 19 merges in the upper housing portion 18*a*, and which for a predeterminable distance in the direction toward the element chamber 14 the bore tapers back down again to the earlier bore diameter, this communication however being closed off by the end of the slide 20, in the position of the pre-injection slide 20 shown in FIG. 3**, from the upper end region thereof.

The resultant upper end closure face F2 of the pre-injection slide, which adjoins the element chamber 14 via an inlet region 28, corresponds to the bore diameter and is subjected to the high-pressure influence of the element chamber during the injection stroke, and is definitive for the pressure intensification which takes place in the pre-injection and therefore is related to the annular face F1.

For the sake of efficiency (to facilitate making the bores, recesses and conduits, for example), the housing 18 is divided in two at 29, forming the upper housing part 18*a* and the lower housing part 18*b*, and at 30 a further housing part is also shown that is already part of the nozzle and forms a nozzle spring chamber 31 and a relief conduit 32 for the spring chamber 33 of the pre-injection and relief slide 20. The injection pressure line 25 continues toward the nozzle as indicated by the arrow A. The spring that biases the pre-injection slide 20, until its opening pressure is overcome, is shown at 34.

From the structure described thus far, it is apparent that there is a resultant total stroke for the pre-injection slide 20, as far as the lower stop (in this case, on the adjoining end wall of the nozzle housing part 30), of $H_{ges}$, a part $h_v$ of which total stroke forms the dimensioning stroke for the pre-injection quantity.

A shutoff control means, generally identified by reference numeral 37, for the pre-injection is also shown inside the pre-injection slide 20, substantially including a spring-biased valve piston; its structure and function will be described in further detail below. First, the basic function of the apparatus according to the invention in direct-controlled unit fuel injectors for generating pre-injections will be explained.

As soon as the magnetic valve 11 closes the inflow conduit or more aptly the connecting conduit 17 to the element chamber 14, during the downward stroke of the high-pressure piston 12 and in timely fashion at a predetermined instant (adapted to the particular operating point of the Diesel engine at that instant), pressure builds up in the element chamber 14; once this pressure exceeds the opening pressure, which is substantially determined by the biasing spring 34, the pressure sets the pre-injection slide 20 in motion, in a downward direction as seen in the plane of the drawing in FIG. 3. It should be noted in this connection that the orientation of the intermediate element 15 in FIG. 3 corresponds to its position in the overview of FIG. 1, for the sake of better comprehension.

The buildup of pressure in element chamber 14 applies a pressure on the end at F2 of relief slide 20 which forces the relief slide downwardly. As the relief slide is forced downwardly, fuel in chambers 23 and 33 are forced out via transverse channel 24 into injection line 25 and out through relief bore 32 into chamber 31. Since the chamber 27 is closed by the upper end of a slide 20, pressure of the fuel in chamber 23, channel 24 and injection line 25 increases as the relief slide 20 is forced downwardly. When the relief slide 20 moves a distance $h_v$, the fluid under pressure from element chamber 14 enters the much larger chamber 27 which reduces the pressure in element chamber 14 thereby relieving the pressure in element chamber 14 such that a back flow from the pressurized injection line 25 tends to flow back toward the element chamber 14 along the upper end 36 of relief slide 20 to equalize the pressure in element chamber 14, chamber 27 and injection line 25.

Because of the movement of the pre-injection slide 20 after supply onset, the ratio of the faces F1 to F2, which is between 1:5 and 1:15, and preferably 1:9, forms a pressure stage and effects a pressure intensification; if numerical values are assumed, for the sake of better comprehension—it being understood that this does not restrict the invention in this direction—then a pressure intensification of 1:9 and an opening pressure of 30 bar, for example, produce pressures in the pressure chamber 23 and the injection line 25 on the order of magnitude of approximately 250 to 300 bar, which are entirely sufficient to effect the desired pre-injection at the nozzle.

Upon a downward movement of the pre-injection slide 20 as set forth above, as soon as its upper control edge (the upper face is beveled, forming a bevel 36) opens up the element chamber 14 toward the injection line 25 (end of the pre-injection stroke $h_v$), the nozzle pressure drops back again toward the opening pressure, here assumed to be 30 bar; in other words, the pre-injection slide 20 relieves the high pressure zone until attaining its final stroke $H_{ges}$; that is, by means of its further downward movement as far as the stop, i.e.,the top face of housing 30, it terminates the pre-injection and effects an injection pause that is predeterminable by the given geometrical characteristics. Then, the pressure for the main injection is built up. The basic function of this portion of the present invention is such that the pressure stage formed by the face F1 of shoulder 21 of pre-injection slide 20, after attainment of the pre-injection stroke $h_v$, effects a relief backward into the element chamber 14, and because of the defined capacity resulting from the further downward movement initiates a pronounced injection pause, until the main injection begins. As soon as the pressure in element chamber 14 and annular chamber 27 has built up again by movement of high-pressure piston 12 further into the element chamber 14, the pressure is built up in injection line 25 leading to the nozzle so that, by further movement of piston 12, pressure for the main injection is accomplished. Main injection pressure is relieved by opening the conduit 17 to the low pressure side N by means of the magnetic valve 11. By movement of piston 12 in a reverse direction, fuel is supplied to element chamber 14.

It will also be apparent in this connection that after the end of supply, as a result of the relief of the element chamber, the pre-injection slide 20 is returned by its biasing spring to the initial position shown in FIG. 3, and from the moment at which the upper control edge again enters into an overlap of the bore forming the pre-stroke interval $h_v$, a fuel-free space is created in the pressure chamber 23. This can be exploited for shutoff control of the pre-injection via the magnetic valve, namely by its being additionally triggered, as set forth below.

To this end, a valve piston 41 is located in the pre-injection slide 20 preferably being supported in a separate slide sheath 38 that is pressed in to a stop at 37 by spring 34. The front end 41*a* of valve piston 41 is pressed onto a seat 40 by a biasing spring 39, and the seat 40 formed on the inner end surface of slide sheath 38 closes off a passage from the spring chamber 33 and the relief bore 32 to a filling bore 42 to the pre-injection pressure chamber 23. The valve piston 41 is embodied such that when its front valve tip 41*a* has lifted sufficiently from the seat 40, the connection into the pre-injection pressure chamber 23 opens up, by means of longitudinal conduits or the like. Finally, a rear relief bore 43 is also provided, which discharges into the element chamber 14.

The following function then results. As noted above, after the end of supply and because of the entry of the pre-injection slide control edge into the overlap, a fuel-free space is created in the pressure chamber 23 for the pre-injection; if this fuel-free space is not refilled between the injections, then as a result of this fuel-free space, the pre-injection fails to occur. This can be readily imagined, because in the event that the fuel-free space is retained until the next injection stroke, the fuel-free space will have to be closed again first, which is effected by means of the pre-injection stroke. The above-described mechanism of the shutoff control by slide 20 exploits this phenomenon, in that if a pre-injection is intended to take place, the magnetic valve 11 that controls the supply of fuel into the vicinity of the element chamber is briefly closed during the intake stroke performed by the high-pressure piston 12. As a result of this closure, the pressure in the element chamber drops to the vapor pressure value, and the resultant pressure drop between the valve spring chamber 33 and the element chamber 14 (acting via the relief bore 43 upon the rear valve spring chamber 44 of the relief control piston 41) causes this piston 41 to rise from its seat and displaces it far enough that fuel flows in from the valve spring chamber 33 of the pre-injection slide 20, along the piston 41 and via the shutoff control filling bore 42 into the pre-injection pressure chamber 23.

Those skilled in the art will forsee that because of the additional utilization of the already present magnetic valve 11 and its correspondingly timely triggering, which can be done without substantial additional expense, not only to assure a sufficiently fine and accurate metering of the pre-injection quantity and of the injection pause, but also either to assure the pre-injection, or to suppress it, namely by omitting the additional triggering of the magnetic valve 11 during the intake stroke. Optionally, it is also possible, by means of a timely adaptation to the course of the intake stroke, to vary the pre-injection such that via the fuel-free space, by means of a corresponding timing of the magnetic valve triggering, the pre-injection can be metered.

It is therefore possible to permit the pre-injection, in accordance with an operating point in the performance graph of load and rpm of the Diesel engine, or to shut it off, for instance at high rpm and load; between these two states, if the trigger signal for the magnetic valve is positioned at the proper time, it is optionally also possible to effect smooth transitions between the performance graph zones with and without pre-injection, as long as the overriding electronic regulation intrinsically authorizes the increased fuel quantity required upon shutoff of the pre-injection.

Figure 4:
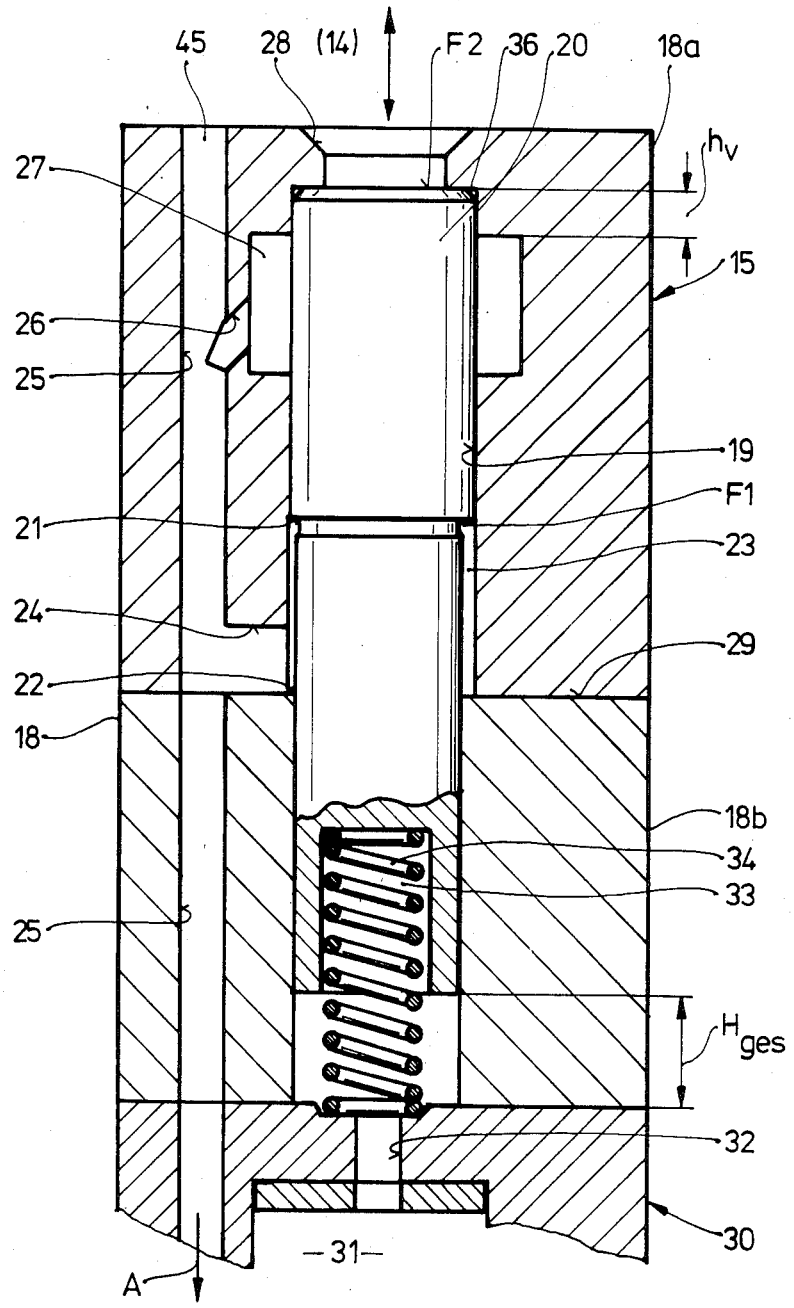
FIG. 4 is a modification of the section shown in FIG. 3.

Finally, in one embodiment of the invention, it is also possible, whenever the option of shutting off the pre-injection can be dispensed with entirely, or in other words whenever the pre-injection can be allowed even for certain ranges of high load and rpm, to dispense with the central bore slide sheath 38 and control piston 41 in the pre-injection slide 20 and the relief bore 43 entirely, and instead to provide a fill bore 45 connected to pressure line 25 as a continuation of the injection line 25 shown in FIG. 4, in which case a provision is made for a general filling of the pressure chamber 23 for the pre-injection between the individual injections, via a control edge control means, not shown in the drawing, on the pump element 13 itself.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for generating pre-injections in fuel injectors for internal combustion engines, a magnetic valve (10) which controls low pressure fuel into an element chamber (14), a fuel input of said apparatus, an injection valve actuation element (13) which operates a spring biased high-pressure piston (2), an intermediate part (15) and an injection nozzle (16) connected to said intermediate part and operative against a spring (**16*b*), said intermediate part includes therein a pre-injection slide (20) that functions under an influence of a fuel pressure generated in said chamber (14) and undergoes a displacement determining a pre-injection quantity with an ensuing main injection by opening a connection to an injection line (25) leading to said injection nozzle (16), whereby a first partial stroke ($h_v$) of said pre-injection slide (20) keeps a connection of a high-pressure side of said pre-injection slide to said injection line (25) sealed forming a fuel pressure intensification by means of a pressure stage (F1/F2) at said pre-injection slide (20) thereby transferring a pre-injection quantity from a pressure chamber (23) of said pre-injection slide (20) to said pressure line (25), further movement of said pre-injection slide (20) resulting in an opening to said high-pressure side, causing a drop in the nozzle pressure and the high-pressure side is relieved by means of the movement of the pre-injection slide until said pre-injection slide reaches its final stroke, and then the main injection is built up by movement of said high-pressure piston (12) into said chamber (14**).

2. An apparatus as defined by claim 1, in which a valve (**40, 41*a*) is disposed in said pre-injection slide (20) forming a shutoff control for the pre-injection, said valve, by means of timely triggering of said magnetic valve (11) which supplies fuel to said element chamber (14) via supply conduits on the high-pressure side of the unit fuel injector and which closes the supply conduits upon an injection stroke, is acted upon during an intake stroke for filling up a pressure chamber (23**) in said pre-injection slide for the pre-injection.

3. An apparatus as defined by claim 1, in which a parallel branch from said element chamber (14) on the high-pressure side of said pre-injection slide (20) is formed as a part of said injection line (25), said branch comprising an inflow (27, 26) to the injection line, which inflow is closed by the pre-injection slide (20) for the duration of the pre-injection stroke ($h_v$), and a fuel capacity resulting from a total stroke ($H_{ges}$) of the pre-injection slide, is continuously closed off to the continuing injection line (25) and is open to the element chamber (14), and relieves the high-pressure zone once again via the inflow (27, 26) which is open after the execution of the pre-injection stroke ($h_v$).

4. An apparatus as defined by claim 2, in which a parallel branch from said element chamber (14) on the high-pressure side of said pre-injection slide (20) is formed as a part of said injection line (25), said branch comprising an inflow (27, 26) to the injection line, which inflow is closed by the pre-injection slide (20) for the duration of the pre-injection stroke ($h_v$), and a fuel flow resulting from a total stroke ($H_{ges}$) of the pre-injection slide, is continuously closed off to the continuing injection line (25) and is open to the element chamber (14), and relieves the high-pressure zone once again via the inflow (27, 26) which is open after the execution of the pre-injection stroke ($h_v$).

5. An apparatus as defined by claim 1, in which said pre-injection slide is slidably supported in a stepped bore (19) of said intermediate part (15) disposed between the high-pressure side and the nozzle (16), and in combination with the stepped bore, by means of an annular face (F1) formed by a shoulder (21), forms a pressure chamber (23) for a pre-injection pressure stage, said pressure stage serving the purpose of pressure intensification, wherein said pressure chamber (23) communicates with the injection line (25).

6. An apparatus as defined by claim 2, in which said pre-injection slide is slidably supported in a stepped bore (19) of said intermediate part (15) disposed between the high-pressure side and the nozzle (16), and in combination with the stepped bore, by means of an annular face (F1) formed by a shoulder (21), forms said pressure chamber (23) for a pre-injection pressure stage, said pressure stage serving the purpose of pressure intensification, wherein said pressure chamber (23) communicates with the injection line (25).

7. An apparatus as defined by claim 3, in which said pre-injection slide is slidably supported in a stepped bore (19) of said intermediate part (15) disposed between the high-pressure side and the nozzle (16), and in combination with the stepped bore, by means of an annular face (F1) formed by a shoulder (21), forms a pressure chamber (23) for a pre-injection pressure stage, said pressure stage serving the purpose of pressure intensification, wherein said pressure chamber (23) communicates with the injection line (25).

8. An apparatus as defined by claim 4, in which said pre-injection slide is slidably supported in a stepped bore (19) of said intermediate part (15) disposed between the high-pressure side and the nozzle (16), and in combination with the stepped bore, by means of an annular face (F1) formed by a shoulder (21), forms said pressure chamber (23) for a pre-injection pressure stage, said pressure stage serving the purpose of pressure intensification, wherein said pressure chamber (23) communicates with the injection line (25).

9. An apparatus as defined by claim 5, in which a pressure face (F2) of the pre-injection slide (20) oriented toward the element the chamber (14) on the pressure side is substantially larger than said annular face (F1) at the pre-injection pressure chamber (23), such that with a long partial stroke ($h_v$) for the pre-injection, a finely metered pre-injection quantity is pumped at high pressure into the injection line (25).

10. An apparatus as defined by claim 1, in which said pre-injection slide (20) over a distance of the pre-injection partial stroke ($h_v$) closes an inflow from the element chamber (14) on the high-pressure side to the injection line (25), said inflow being formed by an annular chamber (27) surrounding said pre-injection slide (20) and by a transverse connecting line (26), and that disposed on the side of the pre-injection slide (20) opposite the chamber (14) is a first spring chamber (33) that enables a full stroke ($H_{ges}$) of the pre-injection slide (20), which spring element chamber communicates with a relief bore (32) leading to a second spring chamber (31) on the nozzle side.

11. An apparatus as defined by claim 2, in which said pre-injection slide (20) over a distance of the pre-injection partial stroke ($h_v$) closes an inflow from the chamber (14) on the high-pressure side to the injection line (25), said inflow being formed by an annular chamber (27) surrounding said pre-injection slide (20) and by a transverse connecting line (26), and that disposed on the side of the pre-injection slide (20) opposite the chamber (14) is a first spring chamber (33) that enables a full stroke ($H_{ges}$) of the pre-injection slide (20), which spring chamber communicates with a relief bore (32) leading to a second spring chamber (31) on the nozzle side.

12. An apparatus as defined by claim 3, in which said pre-injection slide (20) over a distance of the pre-injection partial stroke ($h_v$) closes an inflow from the element chamber (14) on the high-pressure side to the injection line (25), said inflow being formed by an annular chamber (27) surrounding said pre-injection slide (20) and by a transverse connecting line (26), and that disposed on the side of the pre-injection slide (20) opposite the element chamber (14) is a first spring chamber (33) that enables a full stroke ($H_{ges}$) of the pre-injection slide (20), which spring chamber communicates with a relief bore (32) leading to a second spring chamber (31) on the nozzle side.

13. An apparatus as defined by claim 5, in which said pre-injection slide (20) over a distance of the pre-injection partial stroke ($h_v$) closes an inflow from the element chamber (14) on the high-pressure side to the injection line (25), said inflow being formed by an annular chamber (27) surrounding said pre-injection slide (20) and by a transverse connecting line (26), and that disposed on the side of the pre-injection slide (20) opposite the element chamber (14) is a first spring chamber (33) that enables a full stroke ($H_{ges}$) of the pre-injection slide (20), which spring chamber communicates with a relief bore (32) leading to a second spring chamber (31) on the nozzle side.

14. An apparatus as defined by claim 9, in which said pre-injection slide (20) over a distance of the pre-injection partial stroke ($h_v$) closes an inflow from the element chamber (14) on the high-pressure side to the injection line (25), said inflow being formed by an annular chamber (27) surrounding said pre-injection slide (20) and by a transverse connecting line (26), and that disposed on the side of the pre-injection slide (20) opposite the element chamber (14) is a first spring chamber (33) that enables a full stroke ($H_{ges}$) of the pre-injection slide (20), which spring chamber communicates with a relief bore (32) leading to a second spring chamber (31) on the nozzle side.

15. An apparatus as defined by claim 2, in which for a selective shutoff control of said pre-injection via said valve (40) supported in said pre-injection slide (20), said valve is opened, with an upstream slideway, via a connecting conduit (43) to the element chamber (14) on the high-pressure side, and under spring biasing closes a valve seat (40) oriented into a the spring chamber (33) of the pre-injection slide (20), with connecting means (42) that connect a valve chamber (44) with the pressure chamber (23) for the pre-injection when the shutoff control valve is open.

16. An apparatus as defined by claim 15, in which a fuel free space formed in the pressure chamber (23) for the pre-injection upon the entry of an upper control edge of the pre-injection slide (20) into an overlap of a slideway bore (19) is selectively fillable with fuel, upon the return of said pre-injection slide into its initial position, in that during a high-pressure-side intake stroke that comes to an end, said associated magnetic valve (11) is briefly closed, as a result of which the pressure in said chamber (14) drops far enough that a shutoff control valve (41, 40, 41*a*) is raised by the resultant pressure drop in comparison with the spring chamber (33), and fuel flows in from the spring chamber (33) into said pressure chamber (23) for the pre-injection.

17. An apparatus as defined by claim 4, in which after lifting from a valve seat (40) in the pre-injection slide, a valve piston (41) forming the valve for the shutoff control of the pre-injection opens a filling bore (42) oriented toward said pressure chamber (23).

18. An apparatus as defined by claim 2, in which after lifting from a valve seat (40) in the pre-injection slide, a valve piston (41) forming the valve for the shutoff control of the pre-injection opens a filling bore (42) oriented toward said pressure chamber (23).

19. An apparatus as defined by claim 3, in which after lifting from a valve seat (40) in the pre-injection slide, a valve piston (41) forming the valve for the shutoff control of the pre-injection opens a filling bore (42) oriented toward said pressure chamber (23).

20. An apparatus as defined by claim 16, in which said pre-injection slide (20), includes a slide sheath (38) which slidably receives the valve (41) of the shutoff control for the pre-injection in guide bore said sheath includes a lower end face, which is set back as compared with a lower end face of the pre-injection slide (20), and forms a support face for a biasing spring (34) of the pre-injection slide (20) and at the same time defines the spring chamber (33).

21. An apparatus as defined by claim 17, in which said pre-injection slide (20), includes a slide sheath (38) which slidably receives the valve (41) of the shutoff control for the pre-injection in a guide bore said sheath includes a lower end face, which is set back as compared with a lower end face of the pre-injection slide (20), and forms a support face for a biasing spring (34) of the pre-injection slide (20) and at the same time defines the spring chamber (33).

22. An apparatus as defined by claim 1, in which if a pre-injection shutoff is dispensed with, the injection line communicating continuously with the pressure chamber (23) for the pre-injection is continued via a filling bore (45) to the pump element in such a way that, for example via a control edge control on the pump element, a filling of fuel-free space takes place between the injections.

23. An apparatus as defined by claim 2, in which if a pre-injection shutoff is dispensed with, the injection line communicating continuously with the pressure chamber (23) for the pre-injection is continued via a filling bore (45) to the pump element in such a way that, for example via a control edge control on the pump element, a filling of fuel-free space takes place between the injections.

24. An apparatus as defined by claim 5, in which if a pre-injection shutoff is dispensed with, the injection line communicating continuously with the pressure chamber (23) for the pre-injection is continued via a filling bore (45) to the pump element in such a way that, for example via a control edge control on the pump element, a filling of fuel-free space takes place between the injections.

25. A method for generating pre-injections in unit fuel injectors for internal combustion engines, in particular Diesel engines, generating a high pressure fuel which influences a pre-injection slide which undergoes a displacement that determines a pre-injection quantity, producing a main injection by opening up an injection line leading to a nozzle, during a first partial stroke ($h_v$) of the pre-injection slide (20), keeping a connection of a high-pressure side to an injection line (25) sealed, forming a pressure intensification at the pre-injection slide (20), transferring the pre-injection quantity to the injection line (25), then opening the connection of the high-pressure side to the injection line (20) by movement of the pre-injection slide (20), and with a drop in the nozzle pressure the high-pressure slide is relieved by means of a shunted pre-injection slide until it reaches its final stroke, and then permitting a main injection built up with subsequent injection.

* * * * *